US006129386A

United States Patent [19]

Brata

[11] Patent Number: 6,129,386

[45] Date of Patent: Oct. 10, 2000

[54] APPARATUS AND METHOD FOR COLLECTING DATA

[76] Inventor: George M. Brata, 20735 N. 62nd Dr., Glendale, Ariz. 85308

[21] Appl. No.: 08/959,574

[22] Filed: Oct. 28, 1997

[51] Int. Cl.[7] ..... B42D 19/00

[52] U.S. Cl. ..... 281/5; 281/20; 283/3; 283/35; 283/36; 283/115; 434/137; 434/147; 434/150

[58] Field of Search ..... 283/2, 3, 4, 115, 283/66.1, 65, 64.1, 34, 35, 36; 281/20, 5; 434/137, 147, 150

[56] References Cited

U.S. PATENT DOCUMENTS

| | | | |
|---|---|---|---|
| 462,650 | 11/1891 | Brown et al. | 283/64.1 |
| 467,118 | 1/1892 | Hawkins . | |
| 600,253 | 3/1898 | Barnes | 283/64.1 |
| 1,676,741 | 7/1928 | Moskowitz | 281/20 |
| 2,377,968 | 6/1945 | Richman . | |
| 3,143,363 | 8/1964 | Falk | 283/35 |
| 3,446,521 | 5/1969 | Logan . | |
| 3,565,462 | 2/1971 | Gottlieb | 283/115 |
| 4,583,763 | 4/1986 | Shacklett, Jr. . | |
| 4,801,157 | 1/1989 | Sink | 283/34 |
| 5,104,146 | 4/1992 | Schulz et al. | 283/2 |
| 5,234,231 | 8/1993 | Hollander et al. | 283/34 |
| 5,419,586 | 5/1995 | Golson | 283/115 |

*Primary Examiner*—Andrea L. Pitts
*Assistant Examiner*—Monica Carter
*Attorney, Agent, or Firm*—Parsons & Goltry; Michael W. Goltry; Robert A. Parsons

[57] ABSTRACT

An apparatus for collecting and cataloging data, the apparatus comprising a base, an accordion-pleated folded strip mounted with the base and defining sections each having a major surface for the recordation of information thereon, each section hingedly foldable into an overlying position relative an adjoining section to allow a selective upward exposure of a pair of adjoining major surfaces of selected adjacent sections, and an indexing element having a first major surface and a second major surface and mounted with the base for hinged movement between first and second positions, the first position of the indexing element to align with a one of the pair of adjoining major surfaces of selected adjacent sections and the second position of the indexing element to align with another one of the pair adjoining major surfaces of selected adjacent sections.

16 Claims, 4 Drawing Sheets

FIG. 4
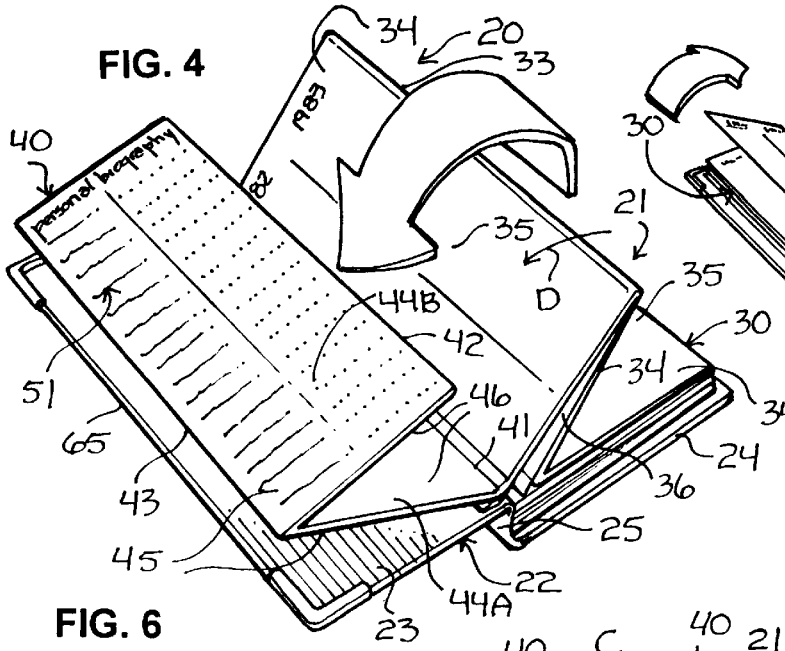
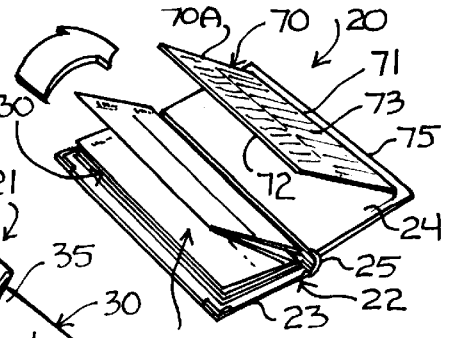
FIG. 5
FIG. 6
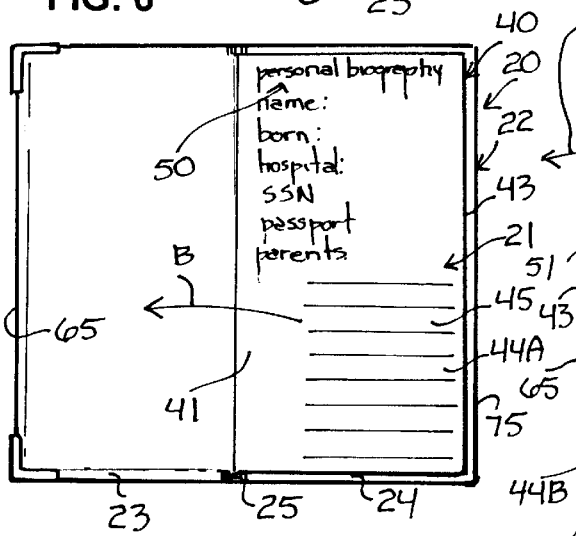
FIG. 7
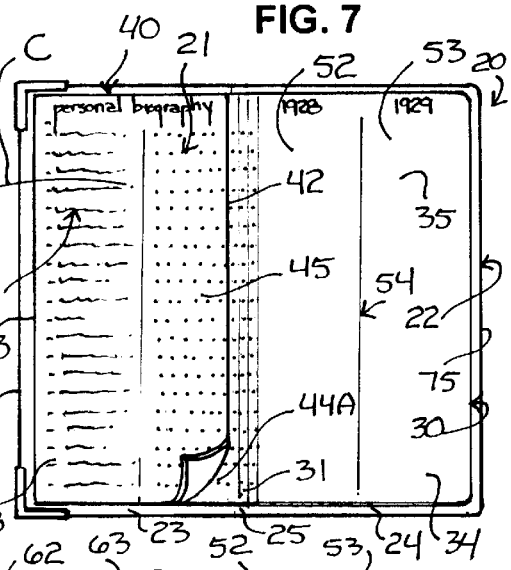
FIG. 8
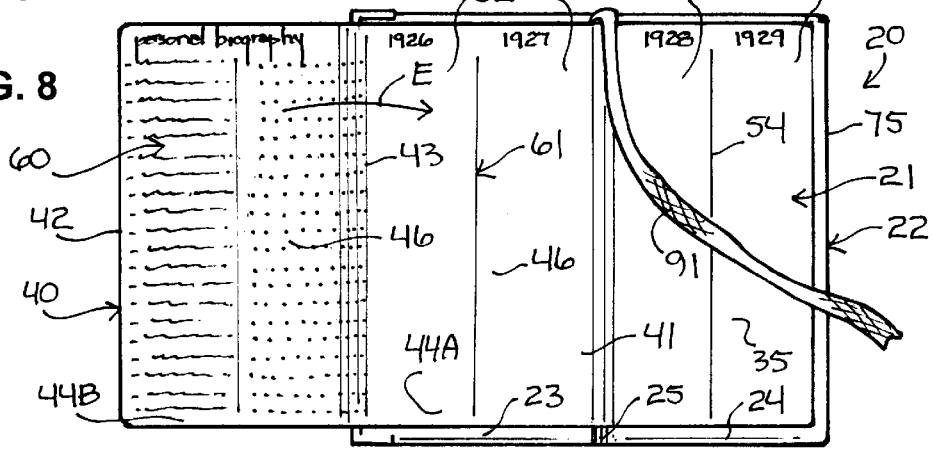

APPARATUS AND METHOD FOR COLLECTING DATA

BACKGROUND OF THE INVENTION

1. Field of the Invention

This invention relates generally to the field of data collection apparatus.

More particularly, this invention relates to a device for collecting and cataloging data.

2. Prior Art

The prior art is replete with various devices operative for allowing a user to collect various kinds of information or data. For instance, diaries, journals, laboratory notebooks, and day planners are just a few examples of the many devices useful for allowing a user to collect and catalog selected information or data.

Those having regard toward the relevant art will readily appreciate that the foregoing and similar devices useful for allowing a user to collect information have experienced little change to increase the ease and efficiency of data collection, organization and cataloging. Accordingly, the apparent lack of devotion directed toward increasing the ease and efficiency of data collection, organization and cataloging therefore necessitates certain new and useful improvements.

It would be highly advantageous, therefore, to remedy the foregoing and other deficiencies inherent in the prior art.

Accordingly, it is an object of the present invention to provide a new and improved apparatus for allowing a user to collect and catalog information.

Another object of the present invention is to provide an apparatus for allowing a user to collect and catalog information that is easy to construct.

And another object of the present invention is to provide an apparatus for allowing a user to collect and catalog information that is inexpensive.

Still another object of the present invention is to provide an apparatus for allowing a user to collect and catalog information that is easy to use.

Yet another object of the instant invention is to provide an apparatus for allowing a user to collect and catalog information that is convenient.

Yet still another object of the instant invention is to provide an apparatus for allowing a user to collect and catalog information regarding significant events throughout the duration of the user's life.

And a further object of the invention is to provide an apparatus for allowing a user to record and catalog information that allows a user to easily display recorded information.

Still a further object of the immediate invention is to provide a new and improved method of collecting and cataloging information.

Yet a further object of the invention is to provide an apparatus for allowing a user to collect and catalog information that is efficient and highly organized.

Yet still a further object of the present invention is to provide an apparatus for allowing a user to collect and catalog information regarding the user's life and operative for allowing a user to view and duplicate one or more selected periods, events or happenings of the user's life.

SUMMARY OF THE INVENTION

Briefly, to achieve the desired objects of the instant invention in accordance with a preferred embodiment thereof, provided is an apparatus for a user to collect and catalog selected information or data. In a preferred embodiment, the apparatus is generally comprised of a cover or base and an accordion-pleated folded strip mounted with the base. The strip defines sections mounted with the base in series and each having a major surface for the recordation of information or data thereon. Each section of the strip is hingedly foldable into an overlying position relative an adjoining section to allow a selective upward exposure of a selected pair of adjoining major surfaces of selected adjacent sections.

An indexing element or sheet is also provided having a first major surface with indexing indicia and a second major surface with indexing indicia. The indexing element is mounted with the base for hinged movement between first and second positions. The first position of the indexing element operates to align the first major surface with a one of a selected pair of adjoining major surfaces of selected adjacent sections to allow a user to record data on the one of the selected pair of adjoining major surfaces corresponding with the indexing indicia carried by the first major surface of the indexing element. The second position of the indexing element operates to align the second major surface with another one of the selected pair adjoining major surfaces of selected adjacent sections to allow a user to record data on the other one of the selected pair of adjoining major surfaces corresponding with the indexing indicia carried by the second major surface of the indexing element.

In accordance with a preferred embodiment, the apparatus of the present invention may further include another indexing element spaced from the indexing element and having a first major surface with indexing indicia and a second major surface with indexing indicia. The other indexing element may be mounted with the base for hinged movement between first and second positions. The first position of the other indexing element operates to align the first major surface thereof with a one of a selected pair of adjoining major surfaces of selected adjacent sections to allow a user to record data on the one of the selected pair of adjoining major surfaces corresponding with the indexing indicia carried by the first major surface of the other indexing element. The second position of the other indexing element operates to align the second major surface thereof with another one of the selected pair of adjoining major surfaces of selected adjacent sections to allow a user to record data on the other one of the selected pair of adjoining major surfaces corresponding with the indexing indicia carried by the second major surface of the other indexing element.

In an alternate embodiment of the present invention, the apparatus may be generally comprised of a base and a plurality of hingedly divided sections mounted in series with the base for hinged movement. Each one of the plurality of hingedly divided sections defines opposing major surfaces for the recordation of information thereon, each hingedly divided section further being hingedly foldable into an overlying position relative an adjacent hingedly divided section to allow a selective upward exposure of a pair of adjacent major surfaces of selected adjacent hingedly divided sections.

In accordance with the alternate embodiment of the present invention, further included is an indexing element having a first major surface with indexing indicia and a second major surface with indexing indicia. The indexing element is mounted with the base for hinged movement between first and second positions. The first position of the indexing element operates to align the first major surface with a one of a selected pair of adjoining major surfaces of selected adjacent hingedly divided sections to allow a user to record data on the one of the selected pair of adjoining major surfaces corresponding with the indexing indicia carried by the first major surface of the indexing element. The second position of the indexing element operates to align the second major surface with another one of the selected pair of adjoining major surfaces of selected adjacent hingedly divided sections to allow a user to record data on the other one of the selected pair of adjoining major surfaces corresponding with the indexing indicia carried by the second major surface of the indexing element.

The alternate embodiment of the present invention may further include another indexing element spaced from the indexing element and having a first major surface with indexing indicia and a second major surface with indexing indicia. The other indexing element may be mounted with the base for hinged movement between first and second positions. The first position of the other indexing element operates to align the first major surface thereof with a one of a selected pair of adjoining major surfaces of selected adjacent hingedly divided sections to allow a user to record data on the one of the selected pair of adjoining major surfaces corresponding with the indexing indicia carried by the first major surface of the other indexing element. The second position of the other indexing element operates to align the second major surface thereof with another one of the selected pair adjoining major surfaces of selective adjacent hingedly divided sections to allow a user to record data on the other one of the selected pair of adjoining major surfaces corresponding with the indexing indicia carried by the second major surface of the other indexing element.

Consistent with the foregoing embodiments, associated methods may also be provided.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which:

FIG. 4 illustrates a perspective view of the apparatus of FIG. 1, the apparatus shown as it would appear in an open position, in accordance with a preferred embodiment of the present invention;

FIG. 5 illustrates a view very similar to the view of FIG. 4;

FIG. 6 illustrates a top plan view of the apparatus of FIG. 1 shown as it would appear in an open position, in accordance with a preferred embodiment of the present invention;

FIG. 7 illustrates a view similar to the view of FIG. 6;

FIG. 8 illustrates a view similar to the view of FIG. 7;

DETAILED DESCRIPTION OF THE PREFERRED EMBODIMENT

Figure 1:
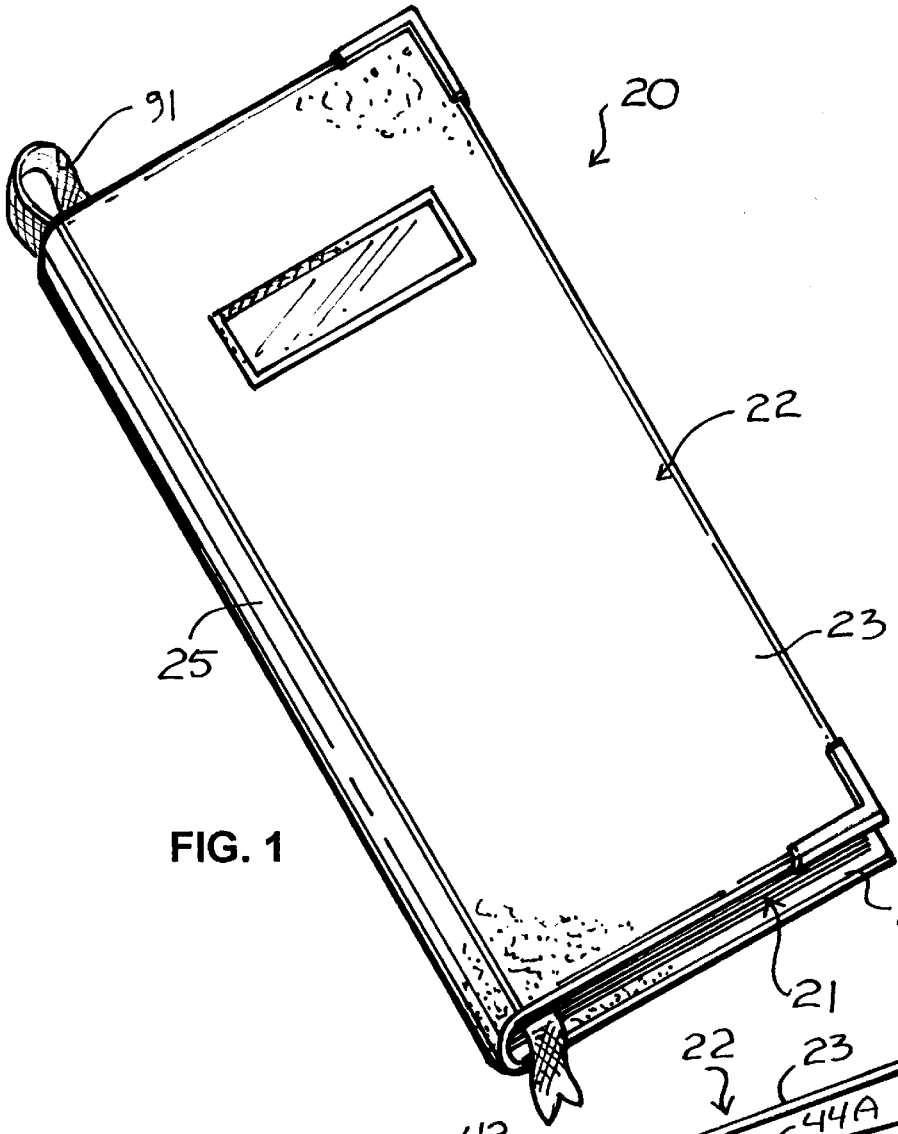
FIG. 1 illustrates a perspective view of an apparatus for a user to collect and catalog data, in accordance with a preferred embodiment of the present invention.

Turning now to the drawings, in which like reference characters indicate corresponding elements throughout the several views, attention is first directed to FIG. 1 which illustrates a perspective view of an apparatus 20 for a user to collect and catalog data, in accordance with a preferred embodiment of the present invention. Apparatus 20 is particularly useful for allowing a user to record and catalog significant events and happenings that the user may experience throughout his or her lifetime. However, this is not an essential feature of the present invention as apparatus 20 may be employed for a user to record varying types of data or information as specifically desired. As evidenced in FIG. 1, apparatus 20 is generally comprised of a data collection assembly 21 housed or otherwise carried by a base or cover 22, a physical orientation generally consistent with the structure of conventional bound books or pamphlets.

Figure 2:
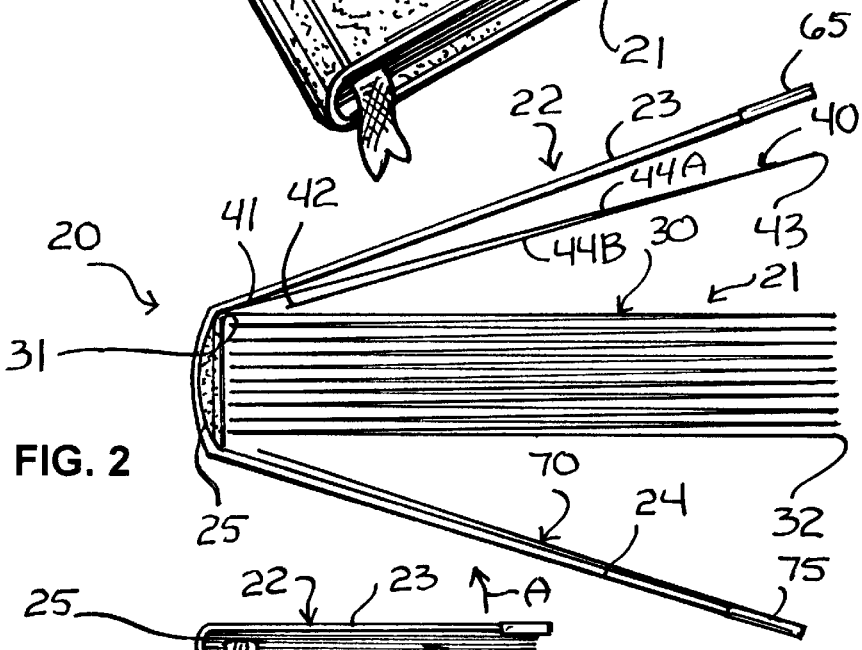
FIG. 2 illustrates an end elevational view of the apparatus of FIG. 1, the apparatus shown as it would appear in a partially opened position, in accordance with a preferred embodiment of the present invention.
Figure 3:
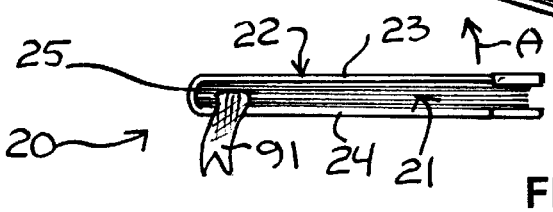
FIG. 3 illustrates another end elevational view of the apparatus of FIG. 1, the apparatus shown as it would appear in a closed position, in accordance with a preferred embodiment of the present invention.

With attention directed to FIG. 2 illustrating an end elevational view of the apparatus of FIG. 1, cover 22 is generally comprised of a top panel 23, a bottom panel 24 and a binder 25 interconnecting top panel 23 with bottom panel 24. Top panel 23 and bottom panel 24 are substantially coextensive and are hingedly mounted, such as by living hinges, with binder 25 to facilitate movement of panels 23 and 24 of cover 22 between a closed position as shown in FIGS. 1 and 3 for capturing data collection assembly 21 between top and bottom panels 23 and 24 and an open position as generally evidenced in FIGS. 4–11 for exposing data collection assembly 21. Those of ordinary skill will readily appreciate that cover 22 is generally representative of well-known hard- and soft-back book covers. Accordingly, further details of cover 22 will not be further addressed as they will readily occur to the skilled artisan. In a particular form of construction, panels 23 and 24 are preferably but not essentially constructed of a size somewhat larger than data collection assembly 21.

With continuing reference to FIG. 2, data collection assembly 21 includes an accordion-pleated folded sheet or strip 30 carried by cover 22 between top and bottom panels 23 and 24. With momentary reference to FIG. 12, strip 30 is preferably constructed of paper or other suitable and like material and includes a first extremity 31, a second extremity 32 and a plurality of equally spaced-apart substantially transverse fold lines 33 extending substantially from first extremity 31 to second extremity 32 dividing strip 30 into joined adjacent sections or sheets 34 each having a first major surface 35 and a second major surface 36. Each fold line 33 defines a living hinge to enable the folding of each sheet 34 into an overlying position relative an adjacent sheet 34 and, in the open position of cover 22, to allow a selective upward exposure of a selected pair of adjoining first major surfaces 35 or perhaps second major surfaces 36 of selected adjacent or adjoining sheets 34.

To mount strip 30 with cover 22, and with attention directed back to FIG. 2, first extremity 31 is preferably but not essentially coupled with binder 25 adjacent the point at which top panel 23 meets binder 25. First extremity 31 may be coupled with binder with a suitable adhesive or other suitable means.

Regarding a preferred embodiment of the present invention, apparatus 20 further includes an indexing strip 40 carried by cover 22 and captured between top panel 23 and strip 30 as clearly evidenced in FIG. 2. With momentary attention directed to FIG. 4, indexing strip 40 is preferably constructed of paper or other suitable and like material and includes a first extremity 41, a second extremity 42 and a substantially transverse fold line 43 dividing indexing strip 40 into joined adjacent sheets 44A and 44B each having a first major surface 45 and a second major surface 46. Fold line 43 defines a living hinge to enable the folding of each sheet 44A and 44B into an overlying position relative the other and, in the open position of cover 22, to allow a selective upward exposure of first major surfaces 45 or second major surfaces 46 of sheets 44A and 44B.

To mount indexing strip 40 with cover 22, and with attention directed back to FIG. 2, first extremity 41 is preferably but not essentially mounted with binder 25 adjacent first extremity 31 of strip 30 at the point at which top panel 23 meets binder 25.

As previously intimated, apparatus 20 is operative for allowing a user to record and catalog data or information. The data or information may take on a variety of forms whether personal data or information or professional data or information. To this end, the foregoing structural features of apparatus and the ensuing discussion of the functional features thereof permit not only ease of recordation but also the efficient cataloging or indexing of selected data or information.

Each first major surface 35 of each sheet 34 of strip 30 is available for the recordation of information or data thereon such as with a pen, pencil or other writing element. Depending upon the type of data a user wishes to record, indexing strip 40 may be supplied with indexing indicia operative to correspond with the type of data a user wishes to record upon first major surface 35 of each sheet 34, further details to be presently discussed.

In operation, and from the closed position of cover 22 as shown in FIG. 3, a user may hingedly move top panel 23 in the direction indicated by the arcuate arrowed line A to the open position of cover 22 as shown in FIG. 6 to expose first major surface 45 of sheet 44A. First major surface 45 of sheet 44A may preferably but not essentially be provided with indicia generally designated by the reference character 50 operative for preferably but not essentially denoting information of the user or perhaps users of apparatus 20 to define ownership of apparatus 20. Such information may include the name of the user, the date of birth of the user and perhaps the hospital where the user was born, the user's social security and passport number and perhaps the names of the user's parents and perhaps other selected information as specifically desired. A user may thus record this information with a pen, pencil or other writing instrument as appropriate for intended use.

From the orientation of apparatus 20 as shown in FIG. 6, a user may grasp indexing strip 40 such as with a hand and hingedly move indexing strip 40 in the direction indicated by the arcuate arrowed line B in FIG. 6 about first extremity 41 to facilitate a selected upward exposure of first major surface 45 of sheet 44B as illustrated in FIG. 7 to thus align first major surface 45 of sheet 44A with a first one of the plurality of first major surfaces 35 of sheets 34 of strip 30. For the purposes of orientation, sheet 44B of indexing strip 40, herein specifically defined as an indexing element, is shown is it would appear overlying sheet 44A in FIG. 7 in a first position thereof. In accordance with the desired objects and advantages of the present invention, first major surface 45 of sheet 44B may be provided with indexing indicia generally designated by the reference character 51 preferably operative for corresponding to the type of information or data a user wishes to record upon first major surface 35 of the first of the plurality of sheets 34 and successive alternating sheets 34. Thus, with first major surface 45 aligned with first major surface 35 of the first one of the plurality of sheets 34 of strip 30, a user may then duly record and catalog, such as with a pen or pencil, information or data corresponding to and aligning with indexing indicia 51. Indexing indicia 51 may be provided upon first major surface 45 by virtue of conventional printing operations.

Regarding a specific example, indexing indicia 51 may preferably but not essentially denote personal indexing data or information regarding significant personal or perhaps professional happenings or events that may arise during the user's life. This indexing information may be provided upon first major surface 45 of sheet 44B in the form of a list and may be comprised of, but not limited to, information regarding the user's home and perhaps vacation address, telephone number, height and weight, brothers, sisters, engagements and marriages, schools and colleges, sports and hobbies, employers and careers, children, vacations, military service, memberships in organizations, clubs and societies, civic activities, special events, major purchases and investments, awards, anniversaries, firsts, pets, medical health, automobiles, historical events, retirement information, deaths, and perhaps other miscellaneous information. Consistent with the desired teachings of the present invention, each first major surface 35 of sheets 34 of strip 30 may be divided or bisected into columns 52 and 53 by indicia generally designated by the reference character 54, each column 52 and 53 preferably corresponding to a period of the user's life such as a day, a week, a month and preferably a year of the user's life. In this regard, a user may record data, such as with a pen, pencil or other writing instrument, corresponding with the indexing indicia 51 in the ones of columns 52 and 53 preferably corresponding with a selected year of the user's life beginning with the first of the plurality of sheets 34 of strip 30 adjacent indexing element 40. Like indexing indicia 51, indicia 54 may be provided by virtue of conventional printing techniques.

From the first position of sheet 44B as shown in FIG. 7 with fold line 43 positioned adjacent a free edge 65 of top panel 23 spaced from first extremity 31 of strip 30, a user may grasp sheet 44B such as with a hand and hingedly move sheet 44B in the direction indicated by the arcuate arrowed line C about fold line 43 to a second position of sheet 44B in FIG. 8 to expose second major surfaces 46 of sheet 44B and 44A, respectively. In the second position of sheet 44B, second major surface 46 thereof is aligned with second major surface 46 of sheet 44A. In this regard, rather than starting the recordation of information on first major surface 35 of the first of the plurality of sheets 34 of strip 30, a user may begin recording information upon second major surface 46 of sheet 44A, although this is not an essential feature. To this end, second major surface 46 of sheet 44B may be provided with indexing indicia generally designated by the reference character 60, such as by conventional printing techniques, to align with second major surface 46 of sheet 44A in the second position of sheet 44B to allow a user to duly record and catalog information corresponding with indexing indicia 60 upon second major surface 46 of sheet 44A. Consistent with the desired teachings of the present invention, indexing indicia 60 is preferably identical to indexing indicia 51 carried by first major surface 45 of sheet 44B. Additionally, and in general similarity to indicia 54, second major surface 46 of sheet 44A may further include indicia 61 operative for bisecting or otherwise dividing second major surface into a pair of columns 62 and 63, each column 62 and 63 to preferably but not essentially correspond to a year or other selected period of a user's life.

From the second position of sheet 44B as shown in FIG. 8, a user may grasp strip 30 at the first of the plurality of fold lines 43 delineating the first of the plurality of sheets 34 of strip 30 from the succeeding one of the plurality of sheets 34 of strip 30 such as with a hand and hingedly move the first and the succeeding one of sheets 34 in the direction indicated by the arcuate arrowed line D as generally evinced in FIG. 4 to allow a selective upward exposure of a pair of adjoining major surfaces 35 of a succeeding pair of adjoining sheets 34, one sheet 34 of the pair to generally overly top panel 23 and the other sheet 34 of the pair to generally overly bottom panel 24. In this manner of operation, and with sheet 44B disposed in the second position as generally indicated in FIG. 8, indexing indicia 60 will be aligned with first major surface 35 of sheet 34 overlying top panel 23. As a result, a user may duly record data or information upon first major surface 35 of sheet 34 overlying top panel 23 in the manner previously described with first major surface 35 of the first of the plurality of sheets 34 of strip 30. To this end, and although not herein specifically shown, each first major surface 35 of each sheet 34 of strip may be provided with indicia bisecting each first major surface 35 into columns each operative to preferably denote a period of a user's life.

In the interest of definition and clarity respecting the ensuing claims, each sheet 34 of strip 30 may be herein defined as a section hingedly foldable into an overlying position relative an adjoining section or sheet 34 to facilitate a selective upward exposure of selected adjacent first major surfaces 35 of selective adjacent sections. Furthermore, adjacent ones of sheets 34 delineated by a fold line 33 may be herein collectively referred to as a hingedly divided section of strip 30, with each first major surface 35 thereof cooperating together to defined opposing major surfaces of the hingedly divided section. In this regard, each hingedly divided section is hingedly foldable into an overlying position relative an adjacent hingedly divided section to allow a selective upward exposure of a pair of selected adjacent first major surfaces 35 of adjacent selected ones of the plurality of hingedly divided sections.

From the second position of sheet 44B as generally indicated in FIG. 8, a user may grasp sheet 44B such as with a hand and hingedly move sheet 44B in the direction indicated by the arcuate arrowed line E in FIG. 8 about fold line 43 to the first position of sheet 44B to expose first major surface 45 of sheet 44B with sheet 44B to overly the one of the pair of first major surfaces 35 of the one of the pair of sheets 34 overlying top panel 23 and to align first major surface 45 of sheet 44B with the first major surface 35 of the other of the pair of sheets 34 overlying bottom panel 24. In the first position of sheet 44B in this regard, and with first major surface 45 of sheet 44B aligned with first major surface 35 of the other of the pair of sheets 34 overlying bottom panel 24, a user may then duly record and catalog data or information upon first major surface 35 of the other of the pair of sheets 34 as herein defined to corresponding with indexing indicia 51.

The foregoing process may be repeated sequentially through selected periods of a user's life corresponding with each sheet 34 with the first position of sheet 44B to align indexing indicia 51 carried by first major surface 45 of sheet 44B with the first major surface 35 of a one of a selected pair of adjoining sheets 34, and the second position of sheet 44B to align indexing indicia 60 carried by second major surface 46 of sheet 44B with the first major surface 35 of another one of a selected pair of adjoining or adjacent sheets 34.

In accordance with the desired objects and advantages of the present invention, apparatus 20 may further include another indexing element 70 carried by cover 22 and captured between bottom panel 24 and strip 30 as clearly set forth in FIG. 2. With momentary attention directed to FIGS. 5, 9 and 10, indexing element 70 is preferably constructed of paper or other suitable and like material and is generally defined as a sheet 70A including a first extremity 71, a second extremity 72, a first major surface 73 (not shown in FIG. 10) and a second major surface 74 (shown only in FIG. 10). To mount indexing element 70 with cover 22, first extremity 71 is preferably but not essentially mounted with bottom panel 24 adjacent a free edge 75 of bottom panel 24, free edge 75, like free edge 65 of top panel 23, being spaced from and substantially transverse relative binder 25.

The operation of indexing element 70 in combination with strip 30 is substantially similar to the operation of sheet 44B comprising the indexing element of indexing strip 40. In this regard, as a user progressive records data onto first major surfaces 35 of sheets 34 of strip 30, a user may alternatively use indexing element 70 in lieu of sheet 44B if desired to align indexing indicia with a selected first major surface 35 of selected ones of sheets 34 of strip 30.

Figure 9:
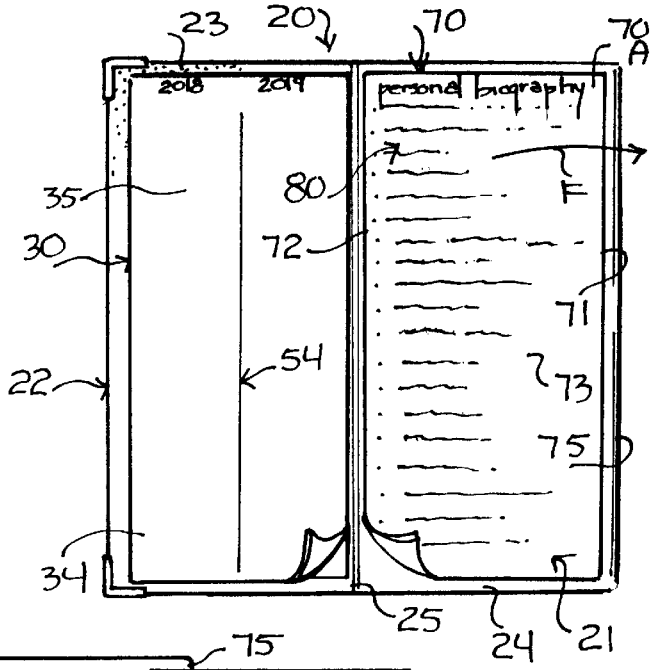
FIG. 9 illustrates a view similar to the view of FIG. 8.

In this regard, first and second major surfaces 73 and 74 may each include indexing indicia 80 (shown in FIGS. 5 and 9) and 81 (shown in FIG. 10) preferably but not essentially substantially identical with indexing indicia 51 and 60 previously discussed in combination with sheet 44B. In FIG. 9, strip 30 is shown completely disposed overlying top panel 23 of cover 22 to expose indexing element 70 in a first position of indexing element 70 overlying bottom panel 24 as evinced by the upward exposure of first major surface 73 shown in desired alignment with the first major surface 35 of a last or terminal sheet 34 of strip 30 positioned to generally overly top panel 23. In accordance with the previous teachings set forth herein, with first major surface 73 aligned with first major surface 35 of the terminal one of the plurality of sheets 34 of strip 30, a user may then duly record and catalog data, such as with a pen or pencil, information or data thereupon first major surface 35 of the terminal one of the plurality of sheets 34 corresponding to and aligning with indexing indicia 80.

Figure 10:
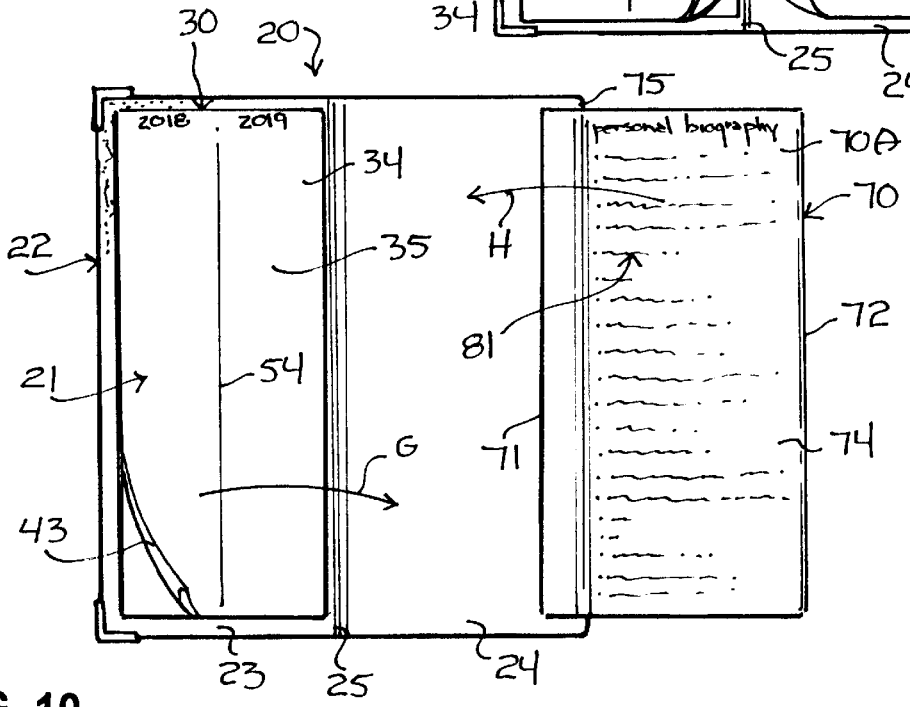
FIG. 10 illustrates a view similar to the view of FIG. 9.

From the first position of indexing element 70, a user may grasp indexing element 70 such as with a hand and hingedly move indexing element 70 in the direction indicated by the arcuate arrowed line F in FIG. 9 about first extremity 71, of which is operative as a living hinge, to a second position of indexing element 70 as evinced in FIG. 10 to expose second major surface 74 of indexing element 70. From the second position of indexing element 70, a user may grasp strip 30 at a terminal one of the plurality of fold lines 43 delineating the terminal one of the plurality of sheets 34 of strip 30 from the preceding one of the plurality of sheets 34 of strip 30 such as with a hand and hingedly move the terminal and the preceding one of sheets 34 in the direction indicated by the arcuate arrowed line G as generally evinced in FIGS. 10 and 11 to allow a selective upward exposure of a pair of adjoining major surfaces 35 (not shown) of a preceding pair of adjoining sheets 34, one sheet 34 of the pair positioned to generally overly top panel 23 and the other sheet 34 of the pair positioned to generally overly bottom panel 24. In this manner of operation, and with indexing element 70 disposed in the second position as generally indicated in FIG. 10, indexing indicia 81 will be aligned with first major surface 35 of sheet 34 of the pair positioned to overly bottom panel 24. As a result, a user may duly record data or information upon first major surface 35 of sheet 34 positioned to overly bottom panel 24.

Figure 11:
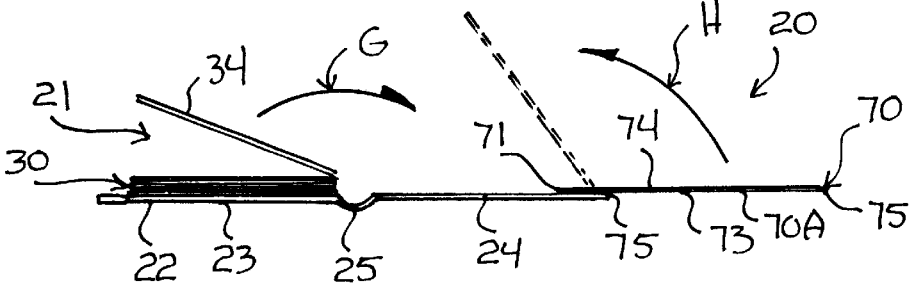
FIG. 11 illustrates an end elevational view of the apparatus of FIG. 1 shown as it would appear in an open position, in accordance with a preferred embodiment of the present invention.

Consistent with the foregoing, and from the second position of indexing element 70, a user may grasp indexing element 70 such as with a hand and hingedly move indexing element 70 in the direction indicated by the arcuate arrowed line H in FIGS. 10 and 11 about first extremity 71 to the first position of indexing element 70 to expose first major surface 73 of indexing element 70. In the first position of indexing element 70 in this manner, indexing indicia will align with the other first major surface 35 of the pair of adjoining sheets 34 preceding terminal sheet 34 of strip 30 to allow a user to record and catalog data with the other first major surface 35 of the pair of adjoining sheets preceding terminal sheet 34 corresponding with indexing indicia 80. The foregoing process may be repeated for allowing a user to selectively align first and second major surfaces 73 and 74 of indexing element 70 with selected first major surfaces 35 of selected ones of adjacent sheets 34 of strip 30 as desired consistent with intended use.

Figure 12:
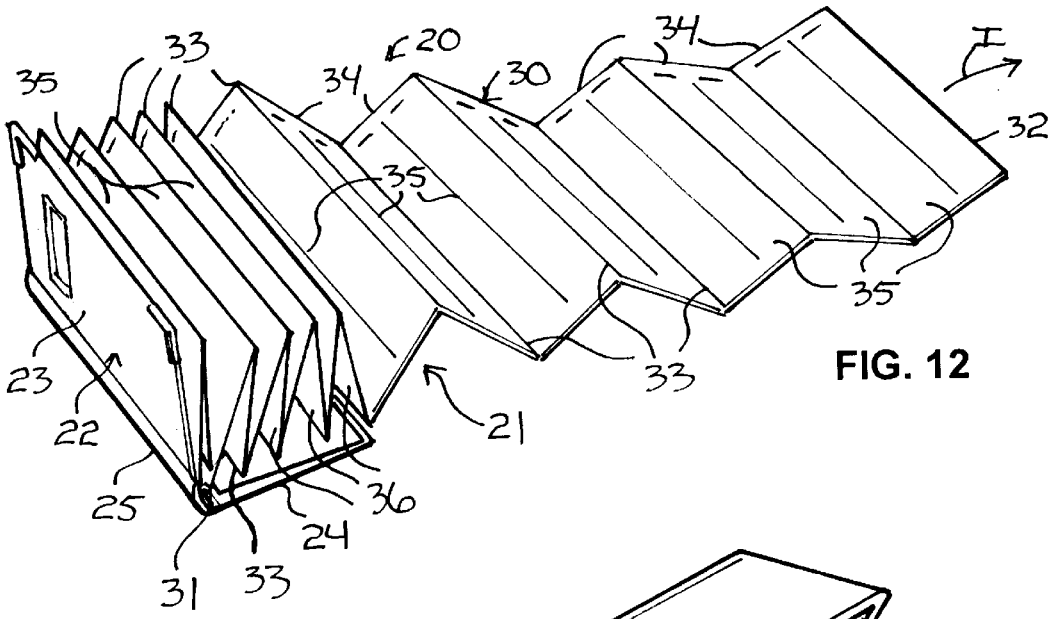
FIG. 12 illustrates another perspective view of the apparatus of FIG. 1, in accordance with a preferred embodiment of the present invention.
Figure 13:
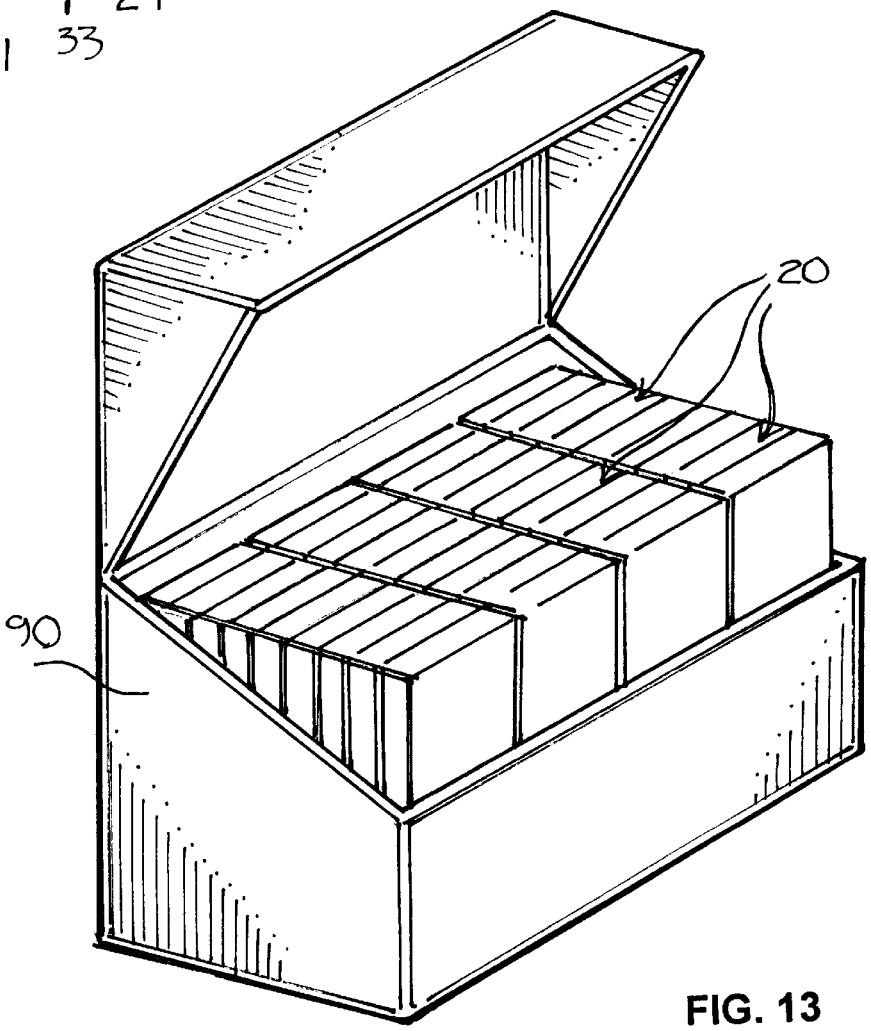
FIG. 13 illustrates a plurality of ones of the apparatus of FIG. 1 shown as they would appear stored within a storage container, in accordance with a preferred embodiment of the present invention.

With momentary reference to FIG. 12, a user may grasp second extremity 32 of strip and pull strip 30 outwardly from base 22 in the direction generally indicated by the arrowed line I to expose the first major surface 35 of each sheet 34 and hence the information or data recorded thereon. As such, and by virtue of the accordion-folded nature of strip 30, a user may easily view recorded data carried by sheets 34 in the foregoing manner.

The present invention has been described above with reference to preferred embodiments. However, those skilled in the art will recognize that changes and modifications may be made in the described embodiments without departing from the nature and scope of the present invention. For instance, although each first major surface 35 of each sheet 34 of strip 30 has been herein disclosed as bearing indicia 54 operative for bisecting or otherwise dividing each first major surface 35 into a pair of adjacent columns 52 and 53, this is not an essential feature. In this regard, those having ordinary skill will readily appreciate that each first major surface 35 of each sheet 34 may be devoted to a single period of a users life corresponding with a single column or more than two periods of a users life naturally corresponding to more than two columns. Furthermore, and due to the compact nature of apparatus 20 in the closed position thereof as illustrated in FIG. 1 and FIG. 3, a plurality of ones of apparatus 20 may be easily stored in upright alignment within a lidded storage container 90. Furthermore, and as shown in FIGS. 1, 3, and 8, apparatus 20 may be equipped with a conventional sash 91 operative much like a conventional bookmark to allow a user to keep his or her place throughout apparatus 20 as desired. In additional, top panel 23, bottom panel 24, sheets 34 of strip 30, sheets 44A and 44B and indexing element 70 are each preferably provided as substantially planar, although this is not essential.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. An apparatus for collecting and cataloging data, comprising:

a base;

an accordion-pleated folded strip mounted with the base and defining sections each including a major surface having a plurality of data entry points for the recordation of information thereon, each section hingedly foldable into an overlying position relative an adjoining section for exposing a pair of adjoining major surfaces of adjacent sections; and an indexing element including a first major surface having first indexing indicia and a second major surface having second indexing indicia, the indexing element mounted with the base for hinged movement between a first position for aligning the first indexing indicia with the plurality of data entry points of one of a pair of adjoining major surfaces of adjacent sections and a second position for aligning the second indexing indicia with the plurality of data entry points of another one of the pair of adjoining major surfaces of the adjacent sections.

2. The apparatus of claim 1, further including another indexing element spaced from the indexing element and including a first major surface having first indexing indicia and a second major surface having second indexing indicia, the other indexing element mounted with the base for hinged movement between a first position for aligning the first indexing indicia of the other indexing element with the plurality of data entry points of one of a pair of adjoining major surfaces of adjacent sections and a second position for aligning the second indexing indicia of the other indexing element with the plurality of data entry points of another one of the pair of adjoining major surfaces of the adjacent sections.

3. The apparatus of claim 1, wherein the indexing element is substantially planar.

4. The apparatus of claim 2, wherein the other indexing element is substantially planar.

5. A method of collecting and cataloging data, comprising the steps of:

providing a base;

providing an accordion-pleated folded strip defining sections each including a major surface having a plurality of data entry points for the recordation of information thereon, each section hingedly foldable into an overlying position relative an adjoining section for exposing of a pair of adjoining major surfaces of adjacent sections;

mounting the strip with the base;

providing an indexing element including a first major surface having first indexing indicia and a second major surface having second indexing indicia;

mounting the indexing element with the base for hinged movement between a first position for aligning the first indexing indicia with the plurality of data entry points of one of a pair of adjoining major surfaces of adjacent sections and a second position for aligning the second indexing indicia with the plurality of data entry points of another one of the pair adjoining major surfaces of the adjacent sections;

recording data to one or more of the plurality of data entry points of the one of the pair of adjoining major surfaces in the first position of the indexing element corresponding with the first indexing indicia; and recording data to one or more of the plurality of data entry points of the other one of the pair of adjoining major surfaces in the second position of the indexing element corresponding with the second indexing indicia.

6. The method of claim 5, further including the steps of:

providing another indexing element including a first major surface having first indexing indicia and a second major surface having second indexing indicia;

mounting the other indexing element with the base spaced from the indexing element for hinged movement between a first position for aligning the first indexing indicia of the other indexing element with the plurality of data entry points of one of a pair of adjoining major surfaces of adjacent sections and a second position for aligning the second indexing indicia of the other indexing element with the plurality of data entry points of another one of the pair of adjoining major surfaces of adjacent sections;

recording data to one or more of the plurality of data entry points of the one of the pair of adjoining major surfaces in the first position of the other indexing element corresponding with the first indexing indicia of the other indexing element; and recording data to one or more of the plurality of data entry points of the other one of the pair of adjoining major surfaces in the second position of the other indexing element corresponding with the second indexing indicia of the other indexing element.

7. An apparatus for collecting and cataloging data, comprising:

a base;

a plurality of hingedly divided sections mounted in series with the base for hinged movement and each defining opposing major surfaces each having a plurality of data entry points for the recordation of information thereon, each hingedly divided section hingedly foldable into an overlying position relative an adjacent hingedly divided section for exposing a pair of adjacent major surfaces of adjacent hingedly divided sections; and an indexing element including a first major surface having first indexing indicia and a second major surface having second indexing indicia, the indexing element mounted with the base for hinged movement between a first position for aligning the first indexing indicia with the plurality of data entry points of one of a pair of adjacent major surfaces of adjacent hingedly divided sections and a second position for aligning the second indexing indicia with the plurality of data entry points of another one of the pair of adjacent major surfaces of the adjacent hingedly divided sections.

8. The apparatus of claim 7, further including another indexing element spaced from the indexing element and including a first major surface having first indexing indicia and a second major surface having second indexing indicia, the other indexing element mounted with the base for hinged movement between a first position for aligning the first indexing indicia of the other indexing element with the plurality of data entry points of one of a pair of adjacent major surfaces of adjacent hingedly divided sections and a second position for aligning the second indexing indicia with the plurality of data entry points of another one of the pair adjacent major surfaces of the adjacent hingedly divided sections.

9. The apparatus of claim 7, wherein the indexing element is substantially planar.

10. The apparatus of claim 8, wherein the other indexing element is substantially planar.

11. A method of collecting and cataloging data, comprising the steps of:

providing a base;

providing a plurality of hingedly divided sections each defining opposing major surfaces each having a plurality of data entry points for the recordation of data thereon;

mounting the plurality of hingedly divided sections in series with the base for hinged movement, each section hingedly foldable into an overlying position relative an adjacent hingedly divided section for exposing a pair of adjacent major surfaces of adjacent hingedly divided sections;

providing an indexing element including a first major surface having first indexing indicia and a second major surface having second indexing indicia;

mounting the indexing element with the base for hinged movement between a first position for aligning the first indexing indicia with the plurality of data entry points of one of a pair of adjacent major surfaces of adjacent hingedly divided sections and a second position for aligning the second indexing indicia with the plurality of data entry points of another one of the pair adjacent major surfaces of the adjacent hingedly divided sections;

recording data to one or more of the plurality of data entry points of the one of the pair of adjacent major surfaces in the first position of the indexing element corresponding with the first indexing indicia; and recording data to one or more of the plurality of data entry points of the other one of the pair of adjacent major surfaces in the second position of the indexing element corresponding with the second indexing indicia.

12. The method of claim 11, further including the steps of:

providing another indexing element including a first major surface having first indexing indicia and a second major surface having second indexing indicia;

mounting the other indexing element with the base spaced from the indexing element for hinged movement between a first position for aligning the first indexing indicia with the plurality of data entry points of one of a pair of adjacent major surfaces of adjacent hingedly divided sections and a second position for aligning the second indexing indicia with the plurality of data entry points of another one of the pair adjacent major surfaces of adjacent hingedly divided sections;

recording data to one or more of the plurality of data entry points of the one of the pair of adjacent major surfaces in the first position of the other indexing element corresponding with the first indexing indicia carried by the first major surface of the other indexing element; and recording data to one or more of the plurality of data entry points of the other one of the pair of adjacent major surfaces in the second position of the other indexing element corresponding with the second indexing indicia carried by the second major surface of the other indexing element.

13. An apparatus for collecting and cataloging data, comprising:

a base;

an accordion-pleated folded strip mounted with the base and defining sections each including a major surface divided into first and second columns each having plurality of data entry points for the recordation of information thereon, each section hingedly foldable into an overlying position relative an adjoining section for exposing a pair of adjoining major surfaces of adjacent sections;

a first indexing element including a first major surface having first indexing indicia and a second major surface having second indexing indicia, the indexing element mounted with the base along one side of the accordion-pleated folded strip for hinged movement between a first position for aligning the first indexing indicia with a plurality of data entry points of a first column of one of a pair of adjoining major surfaces of adjacent sections and a second position for aligning the second indexing indicia with a plurality of data entry points of a first column of another one of the pair of adjoining major surfaces of the adjacent sections; and a second indexing element including a first major surface having first indexing indicia and a second major surface having second indexing indicia, the second indexing element mounted with the base along another side of the accordion-pleated folded strip for hinged movement between a first position for aligning the first indexing indicia with a plurality of data entry points of a second column of one of a pair of adjoining major surfaces of adjacent sections and a second position for aligning the second indexing indicia with a plurality of data entry points of a second column of another one of the pair of adjoining major surfaces of the adjacent sections.

14. A method of collecting and cataloging data, comprising the steps of:

providing a base;

providing an accordion-pleated folded strip defining sections each including a major surface divided into first and second columns each having plurality of data entry points for the recordation of information thereon, each section hingedly foldable into an overlying position relative an adjoining section for exposing a pair of adjoining major surfaces of adjacent sections;

mounting the strip with the base;

providing a first indexing element including a first major surface having first indexing indicia and a second major surface having second indexing indicia;

mounting the indexing element with the base along one side of the accordion-pleated folded strip for hinged movement between a first position for aligning the first indexing indicia with a plurality of data entry points of a first column of one of a pair of adjoining major surfaces of adjacent sections and a second position for aligning the second indexing indicia with a plurality of data entry points of a first column of another one of the pair of adjoining major surfaces of the adjacent sections;

recording data to one or more of the plurality of data entry points of a first column of one of a pair of adjoining major surfaces in the first position of the indexing element corresponding with the first indexing indicia;

recording data to one or more of the plurality of data entry points of a first column of another one of the pair of adjoining major surfaces in the second position of the indexing element corresponding with the second indexing indicia;

providing a second indexing element including a first major surface having first indexing indicia and a second major surface having second indexing indicia;

mounting the second indexing element with the base along another side of the accordion-pleated folded strip for hinged movement between a first position for aligning the first indexing indicia with a plurality of data entry points of a second column of one of a pair of adjoining major surfaces of adjacent sections and a second position for aligning the second indexing indicia with a plurality of data entry points of a second column of another one of the pair of adjoining major surfaces of the adjacent sections;

recording data to one or more of the plurality of data entry points of a second column of one of a pair of adjoining major surfaces in the first position of the second indexing element corresponding with the first indexing indicia of the second indexing element; and recording data to one or more of the plurality of data entry points of a second column of another one of the pair of adjoining major surfaces in the second position of the second indexing element corresponding with the second indexing indicia of the second indexing element.

15. An apparatus for collecting and cataloging data, comprising:

a base;

a plurality of hingedly divided sections mounted in series with the base and each defining opposing major surfaces each divided into first and second columns each having plurality of data entry points for the recordation of information thereon, each section hingedly foldable into an overlying position relative an adjoining section for exposing a pair of adjoining major surfaces of adjacent sections;

a first indexing element including a first major surface having first indexing indicia and a second major surface having second indexing indicia, the indexing element mounted with the base along one side of the accordion-pleated folded strip for hinged movement between a first position for aligning the first indexing indicia with a plurality of data entry points of a first column of one of a pair of adjoining major surfaces of adjacent sections and a second position for aligning the second indexing indicia with a plurality of data entry points of a first column of another one of the pair of adjoining major surfaces of the adjacent sections; and a second indexing element including a first major surface having first indexing indicia and a second major surface having second indexing indicia, the second indexing element mounted with the base along another side of the accordion-pleated folded strip for hinged movement between a first position for aligning the first indexing indicia with a plurality of data entry points of a second column of one of a pair of adjoining major surfaces of adjacent sections and a second position for aligning the second indexing indicia with a plurality of data entry points of a second column of another one of the pair of adjoining major surfaces of the adjacent sections.

16. A method of collecting and cataloging data, comprising the steps of:

providing a base;

providing a plurality of hingedly divided sections each defining opposing major surfaces each divided into first and second columns each having plurality of data entry points for the recordation of information thereon, each section hingedly foldable into an overlying position relative an adjoining section for exposing a pair of adjoining major surfaces of adjacent sections;

mounting the strip with the base;

providing a first indexing element including a first major surface having first indexing indicia and a second major surface having second indexing indicia;

mounting the indexing element with the base along one side of the accordion-pleated folded strip for hinged movement between a first position for aligning the first indexing indicia with a plurality of data entry points of a first column of one of a pair of adjoining major surfaces of adjacent sections and a second position for aligning the second indexing indicia with a plurality of data entry points of a first column of another one of the pair of adjoining major surfaces of the adjacent sections;

recording data to one or more of the plurality of data entry points of a first column of one of a pair of adjoining major surfaces in the first position of the indexing element corresponding with the first indexing indicia;

recording data to one or more of the plurality of data entry points of a first column of another one of the pair of adjoining major surfaces in the second position of the indexing element corresponding with the second indexing indicia;

providing a second indexing element including a first major surface having first indexing indicia and a second major surface having second indexing indicia;

mounting the second indexing element with the base along another side of the accordion-pleated folded strip for hinged movement between a first position for aligning the first indexing indicia with a plurality of data entry points of a second column of one of a pair of adjoining major surfaces of adjacent sections and a second position for aligning the second indexing indicia with a plurality of data entry points of a second column of another one of the pair of adjoining major surfaces of the adjacent sections;

recording data to one or more of the plurality of data entry points of a second column of one of a pair of adjoining major surfaces in the first position of the second indexing element corresponding with the first indexing indicia of the second indexing element; and recording data to one or more of the plurality of data entry points of a second column of another one of the pair of adjoining major surfaces in the second position of the second indexing element corresponding with the second indexing indicia of the second indexing element.

* * * * *